US007537467B1

(12) United States Patent
Gretz

(10) Patent No.: US 7,537,467 B1
(45) Date of Patent: May 26, 2009

(54) GROUNDING TERMINAL BLOCK ASSEMBLY FOR MULTIPLE SERVICES

(75) Inventor: Thomas J. Gretz, Clarks Summit, PA (US)

(73) Assignee: Arlington Industries, Inc., Scranton, PA (US)

( * ) Notice: Subject to any disclaimer, the term of this patent is extended or adjusted under 35 U.S.C. 154(b) by 0 days.

(21) Appl. No.: 12/287,244

(22) Filed: Oct. 7, 2008

(51) Int. Cl.
*H01R 4/66* (2006.01)
*H01R 11/09* (2006.01)
*H01R 4/36* (2006.01)

(52) U.S. Cl. ..... 439/108; 439/798; 439/810

(58) Field of Classification Search ..... 439/108, 439/95, 721, 540.1, 814, 797, 798, 810, 709; 361/119
See application file for complete search history.

(56) References Cited

U.S. PATENT DOCUMENTS 4,456,326 A 6/1984 Sauber
4,630,882 A * 12/1986 Naylor et al. ..... 439/444
5,994,989 A * 11/1999 Rowe et al. ..... 335/202
6,176,747 B1 * 1/2001 Rowe et al. ..... 439/721
6,222,717 B1 * 4/2001 Waas et al. ..... 361/119
6,497,592 B1 * 12/2002 Beadle ..... 439/814
7,011,551 B2 * 3/2006 Johansen et al. ..... 439/709
7,097,502 B2 8/2006 Landis et al.
7,147,492 B2 12/2006 Mueller et al.
7,175,484 B1 * 2/2007 Tamm et al. ..... 439/798
2004/0229518 A1 * 11/2004 Landis et al. ..... 439/709

* cited by examiner

*Primary Examiner*—Chandrika Prasad

(57) ABSTRACT

A grounding terminal block assembly for establishing proper grounding or electrical connection to earth through a path of sufficiently low impedance. The grounding terminal block assembly includes an elongated tubular body with a central longitudinal bore and a plurality of threaded bores extending into the body at right angles to the central bore. Fasteners are threaded into one or more of the threaded bores to provide fastening points for one or more phone, data, or cable TV wires. The top of the tubular body includes a threaded nose portion and lock nut for establishing a secure connection to a service panel. Conversely, for providing a grounding block in a standalone configuration without an associated service panel, legs are provided integral with the tubular body for providing direct connection to a wall or other structure.

20 Claims, 8 Drawing Sheets

GROUNDING TERMINAL BLOCK ASSEMBLY FOR MULTIPLE SERVICES

FIELD OF THE INVENTION

This invention relates to terminal blocks for electrical service boxes and specifically to a grounding terminal block that will connect several devices to a service box.

BACKGROUND OF THE INVENTION

The National Electrical Code (NEC) now requires the grounding of data, cable TV, and phone lines. Grounding is the establishment of an electrical connection to earth through a path of sufficiently low impedance. As it relates to data, cable TV, and phone lines, the purpose of grounding is to assist in preventing the destruction of electrical components and property damage from superimposed voltage from lightning and voltage transients. Grounding the various connections to the earth also helps in reducing static charges on equipment surfaces to ensure the proper performance of sensitive electronic equipment. Grounding communications equipment to the earth reduces high voltage from lightning and keeps it from entering into the building or structure via metal cables or raceways. If the metal portions of communication equipment are not grounded in accordance with the NEC, a significant amount of the high energy from the lightning strike will be dissipated within the structure, which can result in equipment and property damage as well as the potential for electric shock. Grounding also helps establish a zero voltage reference point to ensure proper performance of sensitive communications equipment.

It is especially important to ground data, cable TV, phone lines, and other electrical lines as close as possible to the point at which the lines enter the building. Usually this is at the AC service panel or electrical panel that includes the meter can for totalizing the electrical usage. Prior to the NEC's requirements for grounding data, cable TV, and phone lines, grounding systems for service panels provided essentially one ground connection for grounding all the AC voltage leading into the service panel.

Accordingly, what is needed is a device for establishing separate grounding connections to earth for multiple services, including all the various phone, data, and cable TV connections entering the building at the service panel.

SUMMARY OF THE INVENTION

The invention is a grounding terminal block assembly for establishing proper grounding or electrical connection to earth through a path of sufficiently low impedance. The grounding terminal block assembly includes an elongated tubular body with a central longitudinal bore and a plurality of threaded bores extending into the body at right angles to the central bore. Fasteners are threaded into one or more of the threaded bores to provide fastening points for one or more phone, data, or cable TV wires. The top of the tubular body includes a threaded nose portion and lock nut for establishing a secure connection to a service panel. Conversely, for providing a grounding block in a standalone configuration without an associated service panel, legs are provided integral with the tubular body for providing direct connection to a wall or other structure.

OBJECTS AND ADVANTAGES

Several advantages are achieved with the grounding terminal block assembly of the present invention, including:

(1) Grounding terminals are provided for establishing grounding for a plurality of electrical systems, including phone, data, and cable TV systems.

(2) A main body portion is die cast in one piece of metal alloy with superior electrical conduction properties for establishing proper ground.

(3) The grounding terminal block assembly can be connected directly to a service panel or can be used by itself to provide a proper grounding connection for multiple services.

These and other objects and advantages of the present invention will be better understood by reading the following description along with reference to the drawings.

TABLE OF NOMENCLATURE

Figure 1:
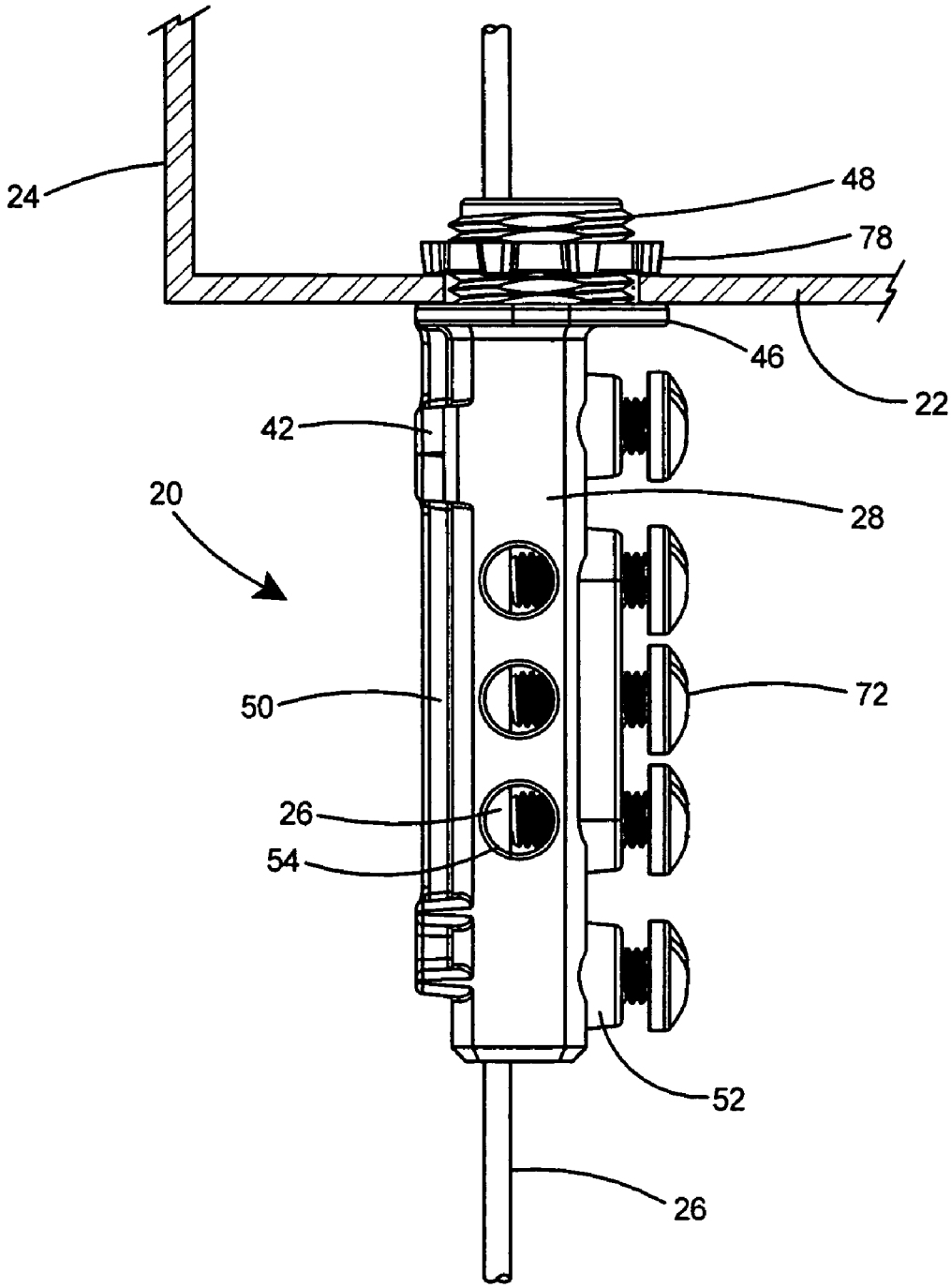
FIG. 1 is a side view of a preferred embodiment of a grounding terminal block assembly connected to a service panel according to the present invention.

The following is a listing of part numbers used in the drawings along with a brief description:

| Part Number | Description |
|---|---|
| 20 | grounding terminal block assembly |
| 22 | wall of meter can |
| 24 | meter can |
| 26 | ground wire |
| 28 | tubular body portion |
| 30 | top end of tubular body |
| 32 | bottom end of tubular body |
| 34 | front surface of tubular body |
| 36 | rear surface of tubular body |
| 38 | side surface of tubular body |
| 40 | central bore |
| 42 | leg |
| 43 | front surface of leg |
| 44 | aperture in leg |
| 46 | flange |
| 48 | threaded nose portion |
| 50 | longitudinal rib |
| 52 | boss |
| 54 | side bore |
| 56 | filet |
| 58 | central axis through longitudinal central bore |

-continued

| Part Number | Description |
|---|---|
| 60 | threaded bore |
| 62 | top bore |
| 64 | axis of top bore |
| 66 | axis of side bore |
| 68 | flat rear surface of leg |
| 70 | ground wire fastening arrangement |
| 72 | threaded fastener |
| 74 | rear wall of central bore |
| 76 | first mounting arrangement |
| 78 | locknut |
| 80 | second mounting arrangement |
| 82 | fastener |
| 84 | wall |
| 86 | ground rod |
| 88 | ground wire |
| 90 | cable TV system |
| 92 | data system |
| 94 | phone system |
| 96 | knockout hole |
| D1 | offset distance of top bore from central bore |
| $\theta_1$ | angle of threaded bore with respect to central axis |

DETAILED DESCRIPTION OF THE INVENTION

With reference to FIG. 1, the present invention comprises a grounding terminal block assembly 20 for grounding several service systems to the earth. The grounding terminal block assembly 20 is shown connected to the wall 22 of a meter can 24. A ground wire 26 extends from the meter can 24 and will be connected to a ground rod (not shown). The grounding terminal block assembly 20 includes an elongated tubular body portion 28.

Figure 3:
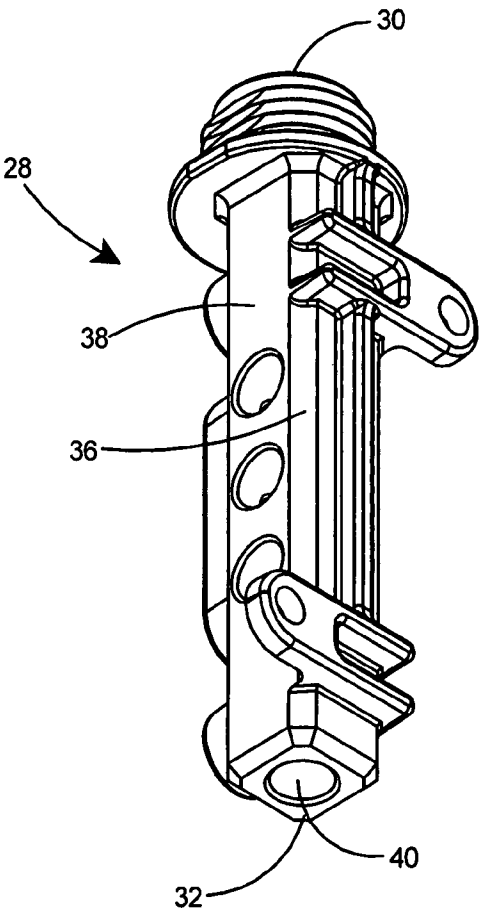
FIG. 3 is a rear perspective view of the tubular body portion.
Figure 2:
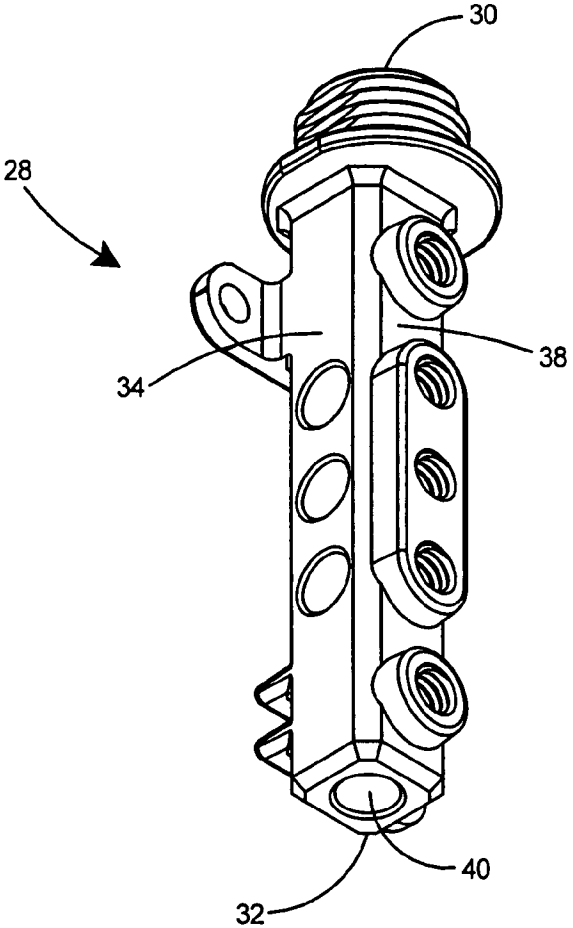
FIG. 2 is a front perspective view of the tubular body portion of the grounding terminal block assembly of FIG. 1.

Referring to FIGS. 2 and 3, the elongated tubular body portion 28 includes a top end 30, a bottom end 32, a front surface 34, a rear surface 36, and two side surfaces 38. The elongated tubular body portion 28 is preferably constructed of electrically conductive metals. The tubular body is preferably produced in one-piece and is die-cast of metal. A longitudinal central bore 40 extends through the elongated tubular body 28.

Figure 4:
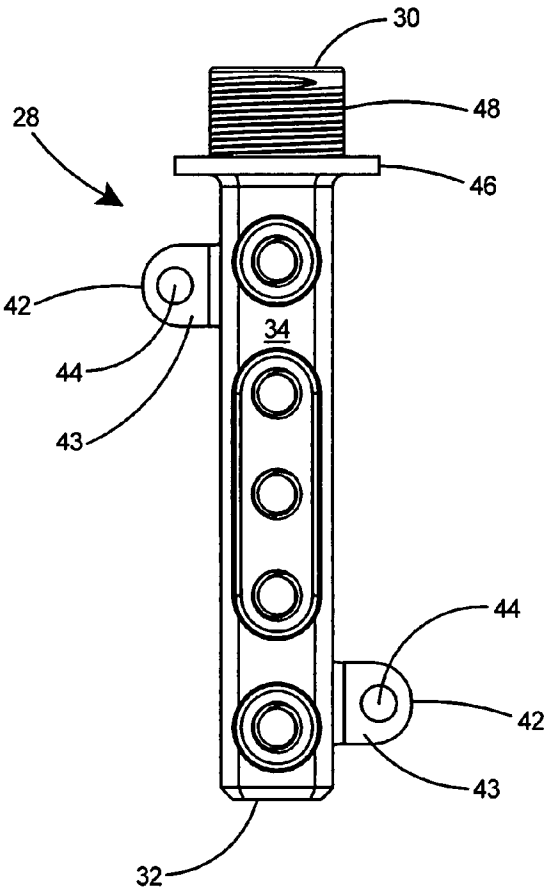
FIG. 4 is a front view of the tubular body portion.

As shown in FIG. 4, the tubular body portion 28 includes two legs 42 integral with and extending outwards from the tubular body portion 28. Each of the legs 42 includes a front surface 43 and an aperture 44 therein. The apertures 44 are at right angles with respect to the front surface 43 of the legs 42 and also with respect to the front surface 34 of the tubular body 28. The tubular body 28 further includes a flange 46 and threaded nose portion 48 on the top end 30.

Figure 5:
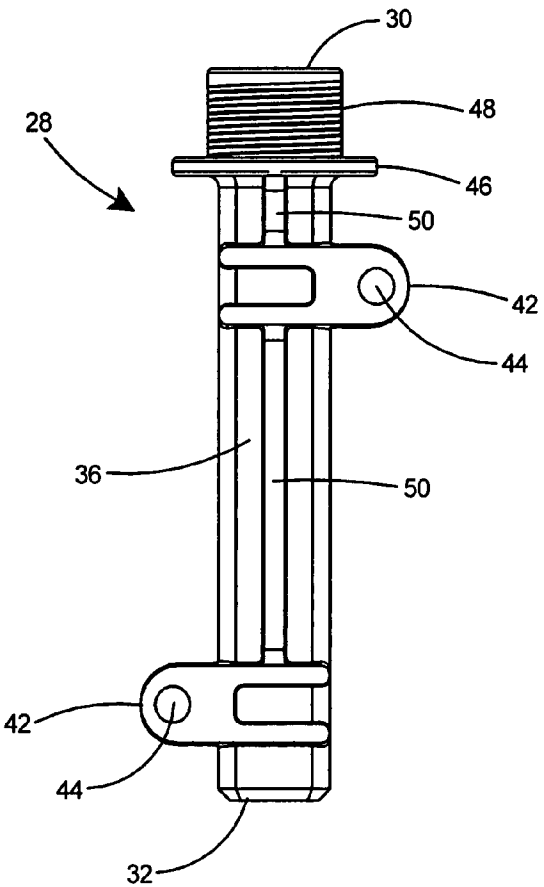
FIG. 5 is a rear view of the tubular body portion.

Referring to FIG. 5, the rear surface 36 of the tubular body 28 includes a longitudinal rib 50 extending there from. The longitudinal rib 50 extends between and joins the two legs 42 and also extends between the top leg 42 and the flange 46. The longitudinal rib 50 extends between the legs 42 thereby providing rigidity and support and bracing the legs 42.

Figure 6:
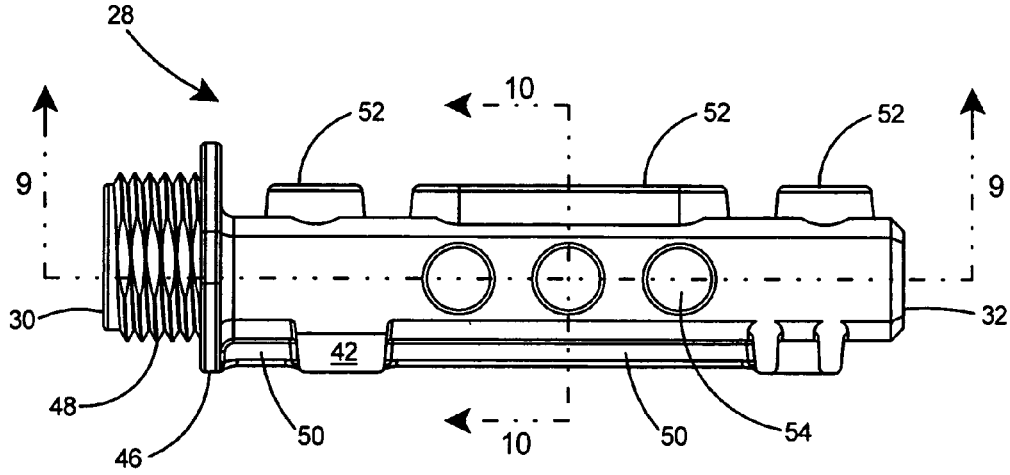
FIG. 6 is a side view of the tubular body portion.
Figure 7:
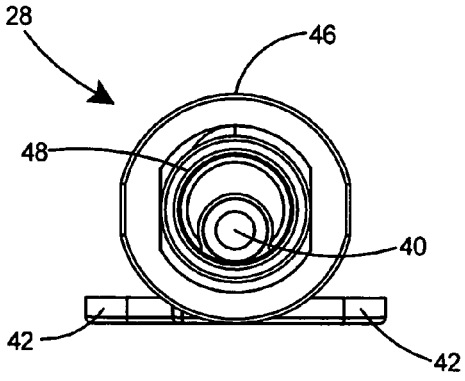
FIG. 7 is a top view of the tubular body portion.
Figure 8:
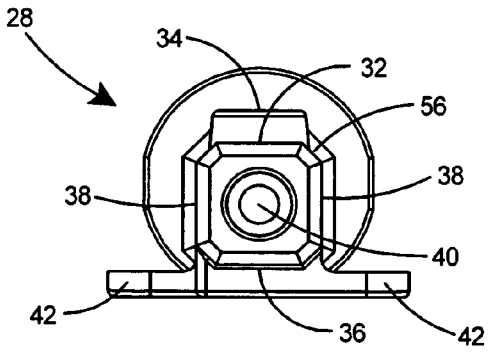
FIG. 8 is a bottom view of the tubular body portion.

With reference to FIGS. 6-8, the tubular body portion 28 includes a plurality of bosses 52 extending from the front surface 34. A plurality of side bores 54 extend through the tubular body 28. A filet 56 is provided around the circumference of tubular body 28 at the juncture of the tubular body 28 with the flange 46. As shown in FIG. 8, the front 34, rear 36, and side surfaces 38 of the tubular body 28 are flat.

Figure 9:
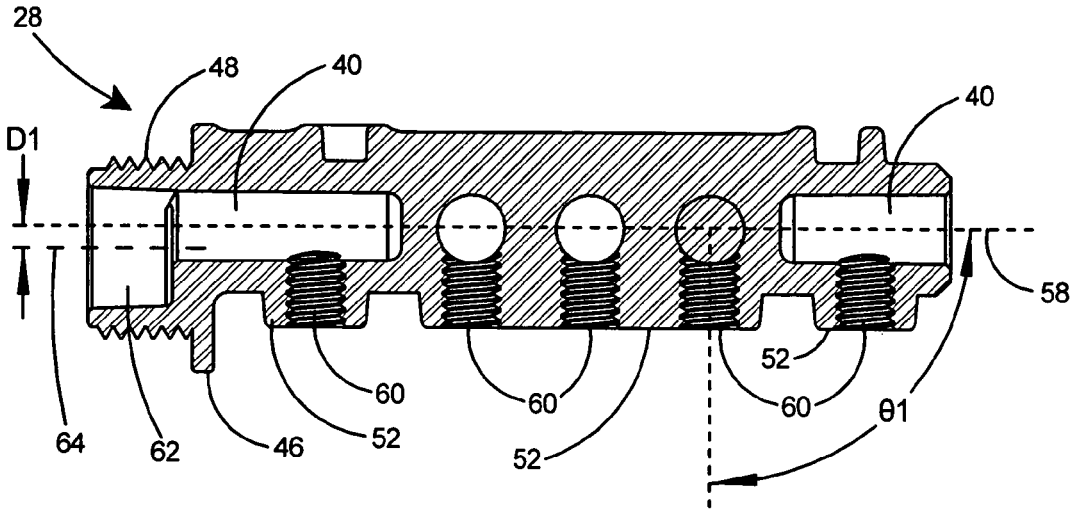
FIG. 9 is a sectional view of the tubular body portion.
Figure 10:
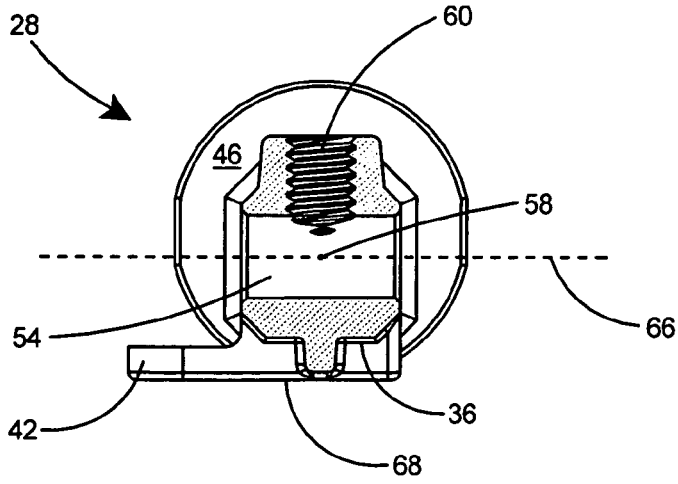
FIG. 10 is a sectional view of the tubular body portion.

Referring to FIGS. 9 and 10, longitudinal central bore 40 extends through the tubular body 28 and includes central axis 58. A plurality of threaded bores 60 are provided extending into the tubular body 28 from the front surface 34 and intersecting the central bore 40 of the body at right angles Θ1. The threaded bores 60 extend through the tubular body 28 and through the bosses 52. Providing the bosses 52 at the location of each threaded bore 60 thereby thickens the tubular body 28 at the location of the threaded bores 60 and provides additional body length for a longer thread length. As shown in FIG. 9, the tubular body 28 includes a top bore 62 within the threaded nose portion 48. The top bore 62 includes an axial center 64. The top bore 62 of the threaded nose portion 48 is eccentric with respect to the central bore 40 of the tubular body 28. The central bore 40 in the tubular body 28 opens into the top bore 62 of the threaded nose portion 48 and the axial center 64 of the top bore 62 is offset from the central bore 40 toward the front surface 34 of the tubular body 28. The top bore 62 is offset from the central bore 40 by distance D1 as shown in FIG. 9, with offset distance D1 preferably between 0.1 and 0.5 inches. As shown in FIG. 10, the side bores 54 extend through the tubular body 28 from the side surfaces 38. Side bores 54 include axial centers 66 and the axial centers 66 of the side bores 54 intersect the central axis 58 of the central bore 40. The legs 42 extending outward laterally from the rear surface 36 of the tubular body 28 include a flat rear surface 68 as shown.

Figure 11:
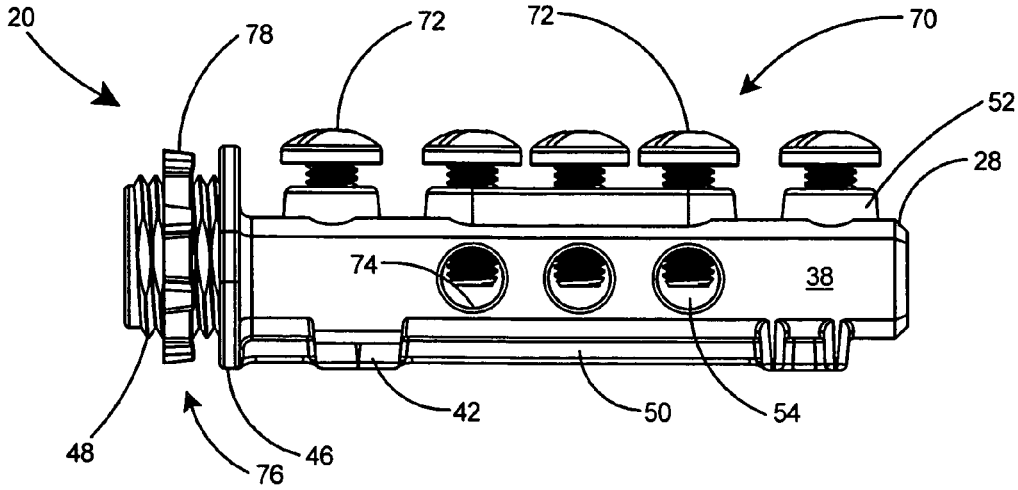
FIG. 11 is a side view of the grounding terminal block assembly of the present invention.
Figure 12:
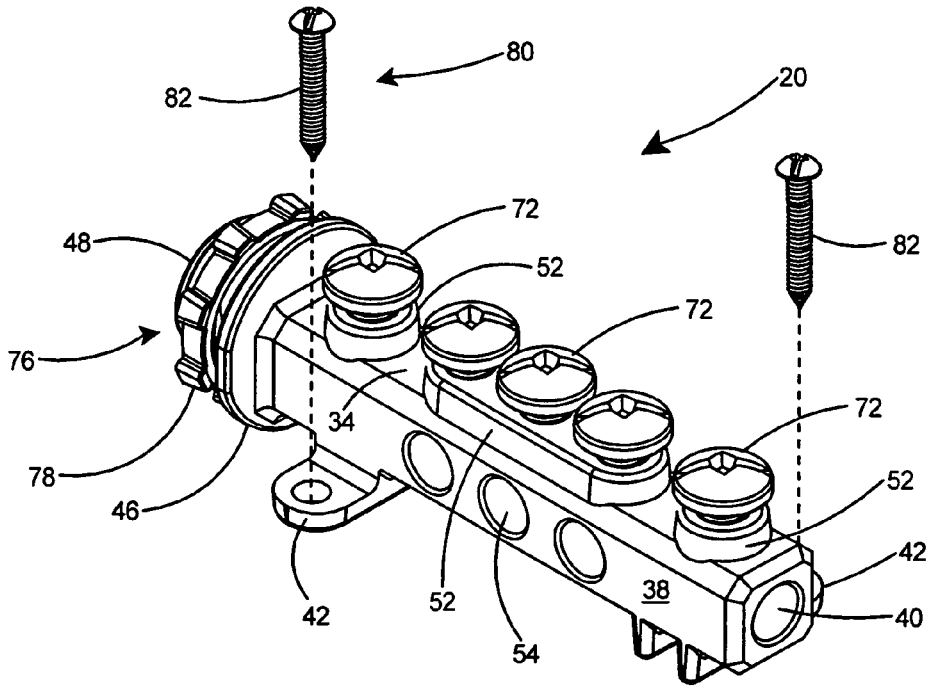
FIG. 12 is a rear perspective view of the grounding terminal block assembly of the present invention.

With reference to FIGS. 11 and 12, the grounding terminal block assembly 20 includes a ground wire fastening arrangement 70. The ground wire fastening arrangement 70 includes a threaded fastener 72 threaded into one or more of the threaded bores 60 in the tubular body 28. The length of the threaded fastener 72 is such that the threaded fastener 72 is capable of to extending completely through the central bore 40 and reaching substantially to the rear wall 74 of the central bore 40. The grounding terminal block assembly 20 further includes a first mounting arrangement 76 on the top end 30 of the tubular body 28 for mounting the tubular body 28 directly to the wall of a meter can box (not shown). The first mounting arrangement 76 includes a lock nut 78 for engaging the threaded nose portion 48 of the tubular body 28. A second mounting arrangement 80 includes fasteners 82 for insertion through apertures 44 in legs 42 for mounting the tubular body 28 to the wall of a structure.

Figure 13:
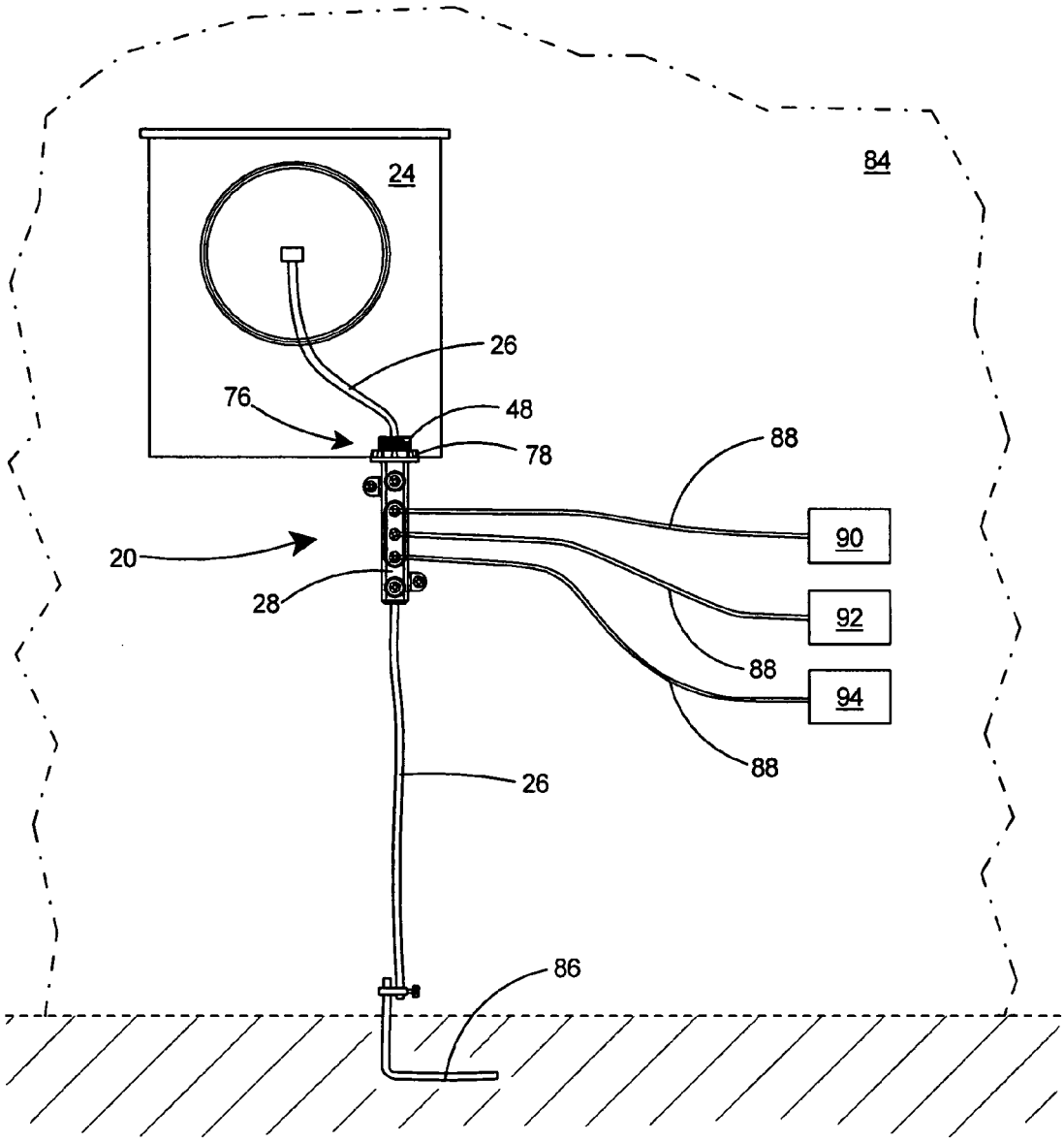
FIG. 13 is a schematic depicting the grounding terminal block assembly of the present invention connected to a meter can and used to provide grounding for multiple services.

As shown in FIG. 13, for the operation of the present invention, the grounding terminal block assembly 20 can be secured to a meter can 24 using the first mounting arrangement 76. A first method of mounting the grounding terminal block assembly 20 includes securing the tubular body 28 to a meter can 24 by extending the threaded nose portion 48 through a knockout or aperture in the meter can 24 and threading the lock nut 78 tightly onto the threaded nose portion 48. The first mounting arrangement 76 utilizes the lock nut 78 to secure the grounding terminal block assembly 20 to a meter can 24 or similar service box that is mounted on a wall 84. Ground wire 26 is then routed through the central bore of the tubular body 28 to connect the electrical meter to earth ground through ground rod 86. Ground wires 88 are then connected by the threaded fasteners 72 to the grounding terminal block assembly 20 and to the cable TV 90, data 92, and phone 94 systems thereby satisfying the requirement of the electrical code to ground these systems.

With reference to FIG. 12, an alternative method for operating the grounding terminal block assembly 20 would involve mounting it directly to a wall (not shown) or similar structure. In this situation the grounding terminal block assembly 20 can be used in a standalone configuration to ground several electrical systems. In this mode of operation, the second mounting arrangement 80 is employed, which includes securing mounting fasteners 82 through apertures 44 in legs 42 into the wall or similar structure. Ground wires (not shown) can then be secured on one end to the grounding terminal block assembly 20 with threaded fasteners 72 and on their opposite ends to the electrical systems (not shown) that require a ground.

Figure 14:
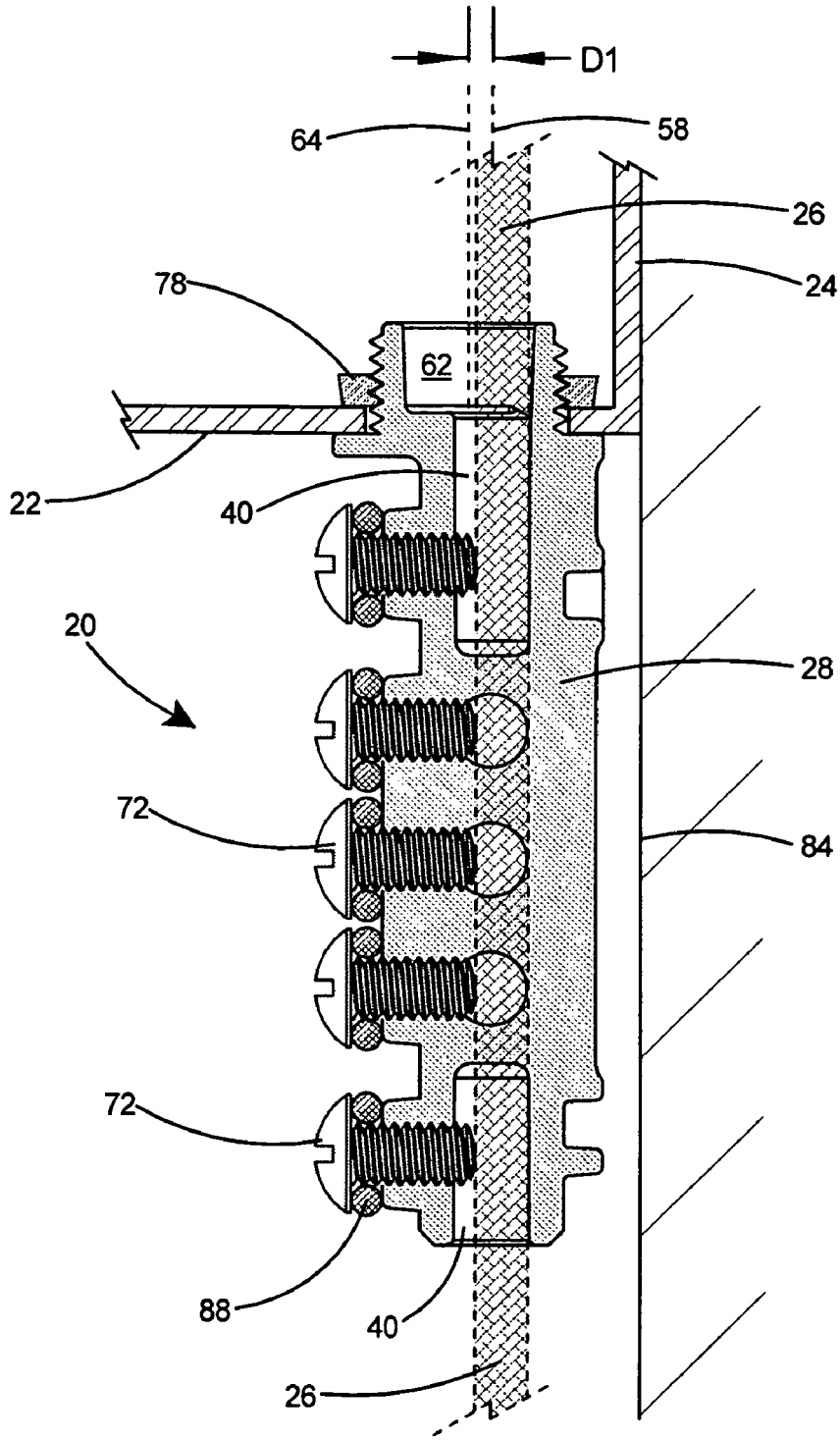
FIG. 14 is a sectional view of the grounding terminal block assembly of the present invention with a ground wire secured therein and wiring from several services secured thereto.

With reference to FIG. 14 there is shown a sectional view of the grounding terminal block assembly 20 of the present invention secured to a meter can 24 that is mounted on a wall 84. A ground wire 26 has been routed through the central bore 40 of the terminal block assembly 20 and secured therein by threaded fasteners 72. Ground wires 88 from several electrical systems (not shown) are secured to the threaded fasteners 72. The offset D1 of the threaded nose portion 48 from the central bore 40 is important as the rear surface 36 of the tubular body 28 is positioned closer to the wall 84 as the grounding terminal block assembly 20 is secured into the knockout hole 96 in the meter can 24. Positioning the tubular body 28 closer to the wall makes it less likely to be struck mistakenly by personnel, vehicles, etc.

As shown in FIG. 1, side bores 54 provide a critical feature to the grounding terminal block assembly 20 of the present invention as they enable an inspector to easily and rapidly view the connection between the ground wire 26 and the threaded fasteners 72. The ability to rapidly check the internal connections within the grounding terminal block assembly 20 is advantageous over many prior art terminal blocks in which the electrical grounding connections are hidden within the assembly and in which it is therefore difficult to check the integrity of the ground wire connections.

The tubular body 28 of the grounding terminal block assembly 20 is preferably constructed of an electrically conductive material. Preferably the tubular body 28 is constructed of metal with preferred metals including zinc, aluminum, brass, copper, and zinc alloys including aluminum, magnesium, and copper. Most preferably the elongated tubular body 28 is die cast in one piece from a die-casting alloy. An especially preferred die-casting alloy is Zamak-7.

Having thus described the invention with reference to a preferred embodiment, it is to be understood that the invention is not so limited by the description herein but is defined as follows by the appended claims.

What is claimed is:

1. A grounding terminal block assembly for multiple services comprising:

an elongated tubular body including a longitudinal central bore with a central axis, a top end, a bottom end, a front surface, a rear surface, and two side surfaces;

a plurality of threaded bores extending into said tubular body from said front surface and intersecting said central bore of said tubular body at right angles;

two legs extending outward laterally from said rear surface of said tubular body, said legs including flat rear surfaces;

a longitudinal rib extending along and centered on said rear surface of said tubular body, said longitudinal rib extending between said legs; and said top end of said tubular body including a flange and a threaded nose portion extending from said flange.

2. The grounding terminal block assembly of claim 1 including a ground wire fastening arrangement on said terminal block assembly;

said ground wire fastening arrangement including a threaded fastener threaded into one or more of said threaded bores; and said threaded fastener including a length enabling said threaded fastener to extend completely through said central bore.

3. The grounding terminal block assembly of claim 1 including side bores extending through said tubular body from said side surfaces, said side bores including axial centers; and said axial centers of said side bores intersecting said center axis of said central bore.

4. The grounding terminal block assembly of claim 1 wherein each of said front, rear, and side surfaces are flat.

5. The grounding terminal block assembly of claim 1 including bosses integral with and extending from said front surface of said tubular body, said threaded bores extending through said bosses.

6. The grounding terminal block assembly of claim 1 including a first mounting arrangement on said top end of said tubular body;

said first mounting arrangement including a lock nut for engaging said threaded nose portion of said tubular body.

7. The grounding terminal block assembly of claim 1 wherein said tubular body includes a top bore within said threaded nose portion, said top bore includes an axial center; and said central bore in said tubular body opens into said top bore of said threaded nose portion.

8. The grounding terminal block assembly of claim 7 wherein said top bore of said threaded nose portion is eccentric with respect to said central bore of said tubular body;

said axial center of said top bore is offset from said central bore toward said front surface of said tubular body.

9. The grounding terminal block assembly of claim 1 wherein each of said legs includes a front surface; and an aperture in each of said legs extending inward from said front surface of said legs, said apertures at right angles with respect to said front surface of said legs.

10. The grounding terminal block assembly of claim 9 including a second mounting arrangement on said grounding terminal block assembly;

said second mounting arrangement including fasteners for securing through said apertures in said legs of said tubular body.

11. The grounding terminal block assembly of claim 1 wherein said elongated tubular body is constructed of metal.

12. The grounding terminal block assembly of claim 11 wherein said metal is selected from the group including zinc, aluminum, brass, copper, and zinc alloys including aluminum, magnesium, and copper.

13. The grounding terminal block assembly of claim 1 wherein said elongated tubular body is die cast in one piece from a die-casting alloy; and said die-casting alloy is Zamak-7.

14. The grounding terminal block assembly of claim 1 including a filet around the circumference of said tubular body at the juncture of said tubular body with said flange.

15. A grounding terminal block assembly for multiple services comprising:

an elongated tubular body including a longitudinal central bore with a central axis, a top end, a bottom end, a front surface, a rear surface, and two side surfaces;

a plurality of threaded bores extending into said tubular body from said front surface and intersecting said central bore of said tubular body at right angles;

two legs extending outward laterally from said rear surface of said tubular body, said legs including flat rear surfaces;

a longitudinal rib extending along and centered on said rear surface of said tubular body, said longitudinal rib extending between said legs;

side bores extending through said tubular body from said side surfaces, said side bores intersecting said center axis of said central bore; and said top end of said tubular body including a flange and a threaded nose portion extending from said flange.

16. The grounding terminal block assembly of claim 15 including bosses integral with and extending from said front surface of said tubular body, said threaded bores extending through said bosses.

17. The grounding terminal block assembly of claim 15 including a first mounting arrangement on said top end of said tubular body;

said first mounting arrangement including a lock nut for engaging said threaded nose portion of said tubular body.

18. The grounding terminal block assembly of claim 15 wherein said tubular body includes a top bore within said threaded nose portion, said top bore includes an axial center; and said central bore in said tubular body opens into said top bore of said threaded nose portion.

19. The grounding terminal block assembly of claim 18 wherein said top bore of said threaded nose portion is eccentric with respect to said central bore of said tubular body;

said axial center of said top bore is offset from said central bore toward said front surface of said tubular body.

20. The grounding terminal block assembly of claim 15 including an aperture in each of said legs;

a second mounting arrangement on said grounding terminal block assembly; and said second mounting arrangement including fasteners for securing through said apertures in said legs of said tubular body.

* * * * *